United States Patent [19]

Olson

[11] 3,991,786

[45] Nov. 16, 1976

[54] FLUID CIRCUIT PLATE FOR A CIRCUIT MODULE FOR FLUID DISTRIBUTION

[75] Inventor: Paul E. Olson, Lexington, Ky.

[73] Assignee: American Standard Inc., New York, N.Y.

[22] Filed: Sept. 22, 1975

[21] Appl. No.: 615,556

[52] U.S. Cl. ..... 137/561 R; 137/608

[51] Int. Cl.[2] ..... F15B 13/02

[58] Field of Search ..... 137/561 R, 561 A, 608

[56] References Cited

UNITED STATES PATENTS 3,760,844 9/1973 Olson et al. ..... 137/608

*Primary Examiner*—Alan Cohan
*Assistant Examiner*—Gerald A. Michalsky
*Attorney, Agent, or Firm*—W. F. Poore; R. W. McIntire, Jr.

[57] ABSTRACT

This invention relates to a molded fluid circuit plate which is used in a circuit module that distributes fluid under pressure to a plurality of logic control valve devices that may be removably secured to the circuit module. This molded fluid circuit plate constitutes a slab that has formed in either one or both of its sides, or has extending therethrough, a plurality of polygonal chambers, each chamber being separated from the adjacent chambers disposed thereabout by a plurality of partitions. When the chambers are formed in one or both sides of the circuit plate, one edge of each partition is integral with and severable from the corresponding side of the circuit plate. Each of the opposite ends of each partition on either side of or extending through the circuit plate is integral with one of a pair of a plurality of pairs of strengthening hubs or posts formed on the corresponding side of the circuit plate or extending therethrough, and from which posts radially extend several other partitions, each of which partitions separates a pair of the plurality of chambers.

11 Claims, 5 Drawing Figures

FLUID CIRCUIT PLATE FOR A CIRCUIT MODULE FOR FLUID DISTRIBUTION

BACKGROUND OF THE INVENTION

In U.S. Pat. No. 3,760,844, issued Sept. 25, 1973, to Paul E. Olson et al., and assigned to the assignee of the present application, there is shown a circuit module for fluid distribution which module includes a fluid circuit plate that has formed in one or both of its opposite sides a plurality of polygonal chambers, each chamber being separated from an adjacent chamber by a thin wall or partition. Each end of each of these walls or partitions intersects and is formed integral with two or more other partitions. If this fluid circuit plate were made by casting a thermoplastic material in a mold, such a circuit plate, subsequent to removal from the mold, would creep or flow upon tightly clamping the circuit plate between an upper and a lower cover plate, at least one of which is constructed of a suitable metal, to form a circuit module.

Therefore, it is desirable that the fluid circuit plate be constructed of a more rigid material such as, for example, a thermoset plastic. When the fluid circuit plate is constructed of a thermoset plastic material, which is comparatively brittle, it has been found that, upon effecting severing of a selected single partition, which separates two adjacent chambers, by gripping the partition between the jaws of a suitable tool and thereafter twisting the tool to sever and remove the partition, the locations of the points of severance are not always exactly at the respective opposite ends of the selected partition as would be most desirable. Often a portion of one or more of the intersecting partitions is undesirably removed along with the selected partition, or an unwanted fracture or rupture occurs in one or more of these intersecting partitions. Should such a fracture or rupture occur in a partition separating two adjacent chambers, one of which constitutes a part of one passageway in the fluid circuit plate and the other a part of another passageway in this circuit plate, fluid under pressure flowing through either passageway would flow into the other if no fluid under pressure, or fluid at a lower pressure, were present in the other passageway. The resulting flow of fluid under pressure into this other passageway could cause an undesired operation of the logic control valve device to which this other passageway is connected. Consequently, this fluid circuit plate would be unfit for use and would have to be scrapped.

Accordingly, it is the general purpose of the present invention to provide a molded fluid circuit plate that comprises one or both sides thereof, or extending therethrough, a plurality of polygonal chambers, each separated from the chambers disposed thereabout by a plurality of thin, removable partitions. Each end of each of these partitions is integral with and severable from the corresponding one of one pair of a plurality of pairs of tapered strengthening posts or hubs, each of which has cast or formed integral therewith one end of several partitions each of which extends radially therefrom to a different one of the other posts or hubs.

SUMMARY OF THE INVENTION

According to the present invention, a molded fluid circuit plate has formed on one or both sides therof, or extending therethrough, a plurality of polygonal chambers, each separated from the chambers disposed thereabout by a plurality of thin, removable walls or partitions. Each end of each of these partitions is integral with and severable from one of a pair of tapered strengthening post or hubs disposed at the respective opposite ends of the partition which constitutes one of several partitions extending radially from each one of these strengthening posts to a different one of the other strengthening posts.

When the polygonal chambers are disposed on one or both sides of the fluid circuit plate, one edge of each of the several partitions that form a chamber is integral with and severable from the corresponding side of the fluid circuit plate substantially simultaneously as the ends thereof are severable from the corresponding pair of strengthening posts without fracture of or damage to another partition extending radially from either post.

It has been determined experimentally that when a fluid circuit plate, the partitions of which have a thickness of 0.020 inches, is molded from a thermoset plastic, the diameter of the strengthening posts at their outer end must not be less than 0.094 inches in order to prevent a rupture of or a fracture in a partition other than the partition being removed. These posts, and likewise the partitions, may have, for example, an inward taper of 4° from their inner end.

The outer end of each of these posts abuts the adjacent side of one of the cover plates. Consequently, these outer ends of the plurality of posts extending from a side of the fluid circuit plate into abutting relationship with a cover plate and each having a plurality of partitions, extending radially therefrom, provide a greater load bearing surface for supporting the cover plate than is provided by a plurality of intersecting partitions that are integral with a fluid circuit plate that has no strengthening post.

Figure 1:
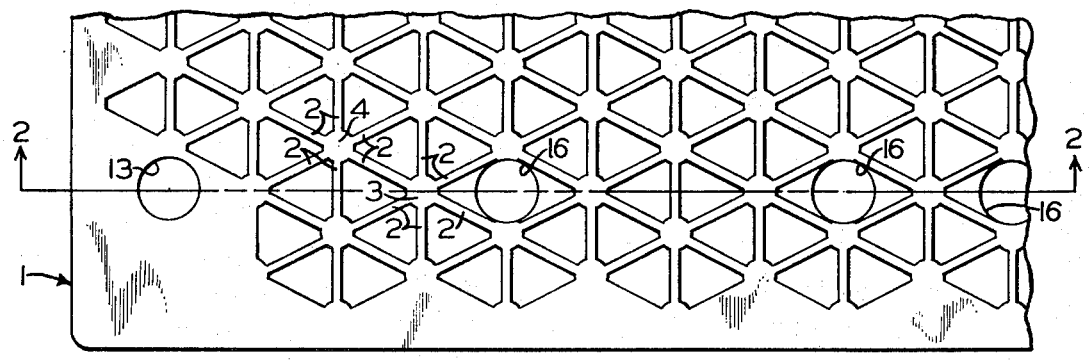
FIG. 1 is a partial plan view of a fluid circuit plate constituting a first embodiment of the invention.
Figure 2:
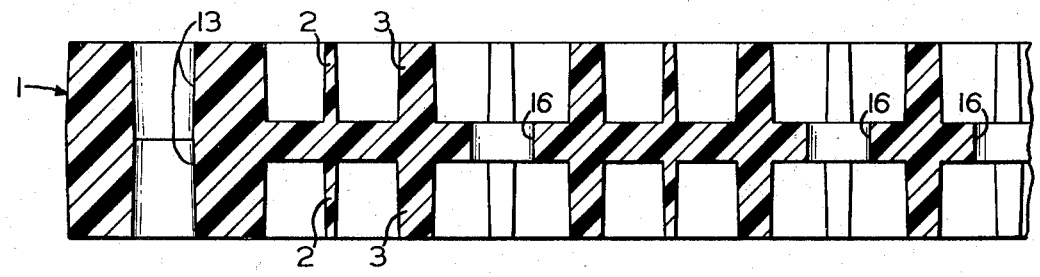
FIG. 2 is a partial elevational veiw, in cross section, taken along the line 2—2 of FIG. 1 and looking in the direction of the arrows, showing further structural details of the fluid circuit plate shown in FIG. 1.
Figure 5:
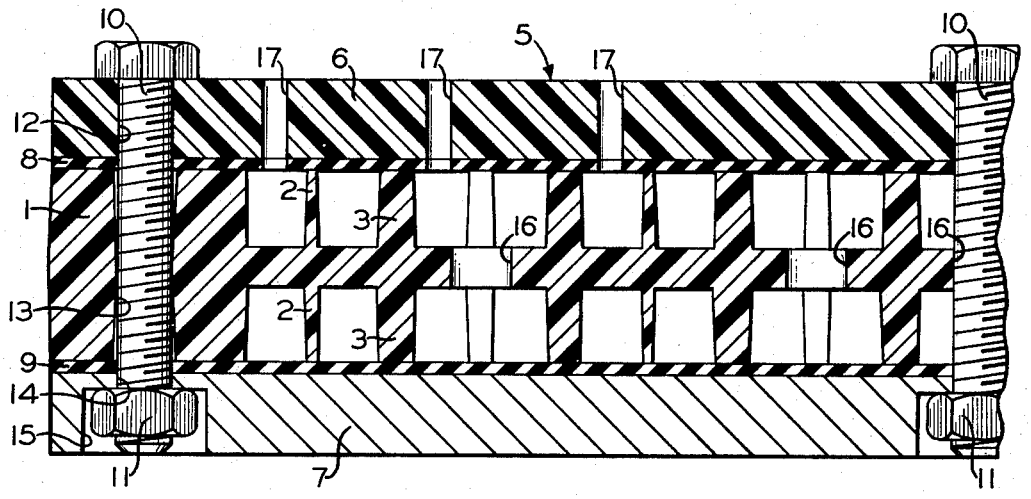

FIG. 5 is a partial elevational view, in cross section, of a circuit module comprising the fluid circuit plate shown in FIGS. 1 and 2 interposed between upper and lower cover plates that are secured to the respective opposite sides of this fluid circuit plate to form the circuit module for the distribution of fluid to logic control valve devices that may be removably mounted on the top cover plate.

Referring to FIGS. 1 and 2, there is respectively shown a plan view, in outline, and an elevational view in cross section, of a fluid circuit plate 1 having a flat plate member that has formed on both its upper and lower sides a plurality of triangular chambers, each chamber being separated from an adjacent chamber by a thin wall or partition 2. It will be understood that any type of polygonal chamber may be used in place of the triangular chambers shown without departing from the spirit of the present invention.

In accordance with the teaching of the present invention, one end of each of a plurality of intersecting partitions 2 on each side of the fluid circuit plate 1, six being shown in FIG. 1, is formed integral with and extends radially from a tapered strengthening post or hub 3 that at one end, as best shown in FIG. 2, is integral with one side of the fluid circuit plate 1. As shown in FIG. 1, the other end of each of the partitions 2 extending radially from the strengthening post 3 is formed integral with another tapered strengthening post, such as the strengthening post indicated by the numeral 4 in FIG. 1, it being noted that the same number of partitions, namely six, extend radially from this strengthening post 4.

Accordingly, it is apparent that each polygonal chamber in the fluid circuit plate 1, such as the triangular chambers shown in FIG. 1, is bounded by a plurality of thin walls or partitions 2 that are formed integral with one side or the other of the fluid circuit plate 1 and at each end are integral with a strengthening post that is also integral at one end with the corresponding side of this fluid circuit plate 1.

Referring now to FIG. 5 of the drawings, there is shown a partial elevational view, in cross-section, of a circuit module 5 for fluid distribution. This circuit module 5 comprises three members, and in order to give the module sufficient rigidity and to reduce module thickness, at least one of these members should be constructed of metal. Therefore, the module 5 comprises, for example, a plastic upper cover plate 6, upon which may be removably mounted a plurality of logic control valve devices (not shown), a lower cover plate 7 which is constructed of metal and a molded cellular thermoset plastic fluid circuit plate such as, or example, the fluid circuit plate 1 shown in detail in FIGS. 1 and 2. There may be formed in the fluid circuit plate 1 and the upper cover plate 6 in a manner hereinafter explained, a plurality of passageways to supply fluid under pressure to the logic control valve devices removably mounted on the upper cover plate 6, or to release fluid under pressure from these devices to atmosphere, or to provide for the flow of fluid under pressure from any one of these valve devices to another, with the exception of piping required to connect a fluid pressure storage reservoir (not shown) to the circuit module 5.

As shown in FIG. 5, a gasket 8 is disposed between the upper cover plate 6 and the fluid circuit plate 1, and a gasket 9 is disposed between this circuit plate 1 and the lower cover plate 7 to provide seals between the plates when they are secured together by a plurality of bolts 10 and nuts 11, only two of each appearing in FIG. 5 of the drawings. The left-hand bolt 10 shown in FIG. 5 extends through a straight smooth bore 12 in the upper cover plate 6, a second bore 13 in the fluid circuit plate 1 that is coaxial with the bore 12 and a third coaxial straight smooth bore 14 in the lower cover plate 7, there being a coaxial counterbore 15 provided in this plate 7 for receiving the nut 11.

The fluid circuit plate 1 may be cast in a mold from a thermoset plastic. The mold for casting therein the fluid circuit plate 1 from a thermoset plastic comprises two parts, the parting line between these two parts being substantially midway the thickness of this fluid circuit plate.

In order to provide the plurality of partitions and strengthening posts that surround each of the plurality of polygonal chambers formed in each side of the fluid circuit plate 1, each part of the mold constitutes a flat metallic plate that has machined, or otherwise formed, in that side thereof adjacent the other part of the mold, tapered cavities corresponding to the plurality of partitions 2 and strengthening posts 3 and 4.

Moreover, this side of this flat plate has machined or otherwise formed therein cavities corresponding to the material surrounding the bore 13 and any desired number of bores 16 for receiving such as the right-hand bolt 10 shown in FIG. 5, or providing for flow of fluid under pressure from a polygonal chamber formed on one side of the fluid circuit plate 1 and constituting a part of a passageway formed in this one side of the fluid circuit plate by the removal of a plurality of selected partitions on this one side to a coaxial polygonal chamber formed on the other side of this circuit plate and constituting a part of a passageway formed in this other side of the fluid circuit plate by the removal of a plurality of selected partitions on this other side.

Consequently, when hot, molten thermoset plastic is poured into the two-part mold, it will completely fill the cavities therein and, thereafter, solidify upon cooling.

Subsequent to the solidifying and cooling of the thermoset plastic in the mold, the two parts of the mold are separated by moving each part in the direction away from the other and thus away from the fluid circuit plate 1.

It is apparent from the foregoing, that, in order to provide for easy separation of the two parts of the mold, the partitions 2 and strengthening posts 3 and 4 must be tapered.

Furthermore, it is apparent that in order to provide for this separation of the two parts of the mold, each half of the length of the bore 13 must be tapered in a direction opposite the taper of the other half since one half is formed in each part of the two-part mold.

The length of the bores 16 or the thickness of the wall that separates the chambers on one side of the fluid circuit plate 1 from the chambers on the opposite side of this circuit plate may be, for example, 0.09 inch. Since the length of these bores 16 is thus very short, it is not necessary that these bores 16 taper in opposite directions from a point midway their length, as does the bore 13, in order to effect easy separation of the two parts of the mold from the fluid circuit plate 1.

Subsequent to removing the fluid circuit plate 1 from the two-part mold, one or more fluid conducting passageways or troughs of any desired configuration can be formed in either the upper or lower set of chambers in the circuit plate 1 or in both sets of chambers, if desired, by removing, as by cutting, breaking or otherwise, the thermoset plastic wall or partition 2 between each pair of adjacent polygonal chambers of a selected plurality of pairs of chambers in this circuit plate and between the strengthening posts, such as the post 3 and 4 shown in FIG. 1, with which the opposite ends of each plastic wall or partition are integral, by any suitable means such as, for example, a pair of pliers, a knife or any other suitable instrument. Whenever the respective opposite ends of any selected partition 2 is thus severed from the corresponding strengthening post 3 and 4, these strengthening posts are effective to prevent or inhibit the occurrence of a rupture or fracture in any of the other several partitions that extend radially from each strengthening post. Absent a rupture or fracture in any of the remaining partitions 2 in the fluid circuit plate 1, there can be no undesired flow of fluid under pressure from one passageway to another in the fluid circuit plate 1 when this circuit plate is clamped tightly between the upper cover plate 6 and lower cover plate 7 by the bolts 10 and nuts 11 to form the circuit module 5 shown in FIG. 5 of the drawings, it being noted that the upper cover plate 6 may be provided with a plurality of bores 17 that extend therethrough for the purpose of conducting fluid under pressure from one of the passageways formed in the fluid circuit plate 1 in the manner just explained to a corresponding one of the aforementioned logic control valve devices that may be secured to this upper cover plate 6. These bores 17 can be provided in any desired location in the upper cover plate 6 by such as, for example, a drilling operation, or, if the cover plate 6 is a casting, they may be cast therein.

Figure 3:
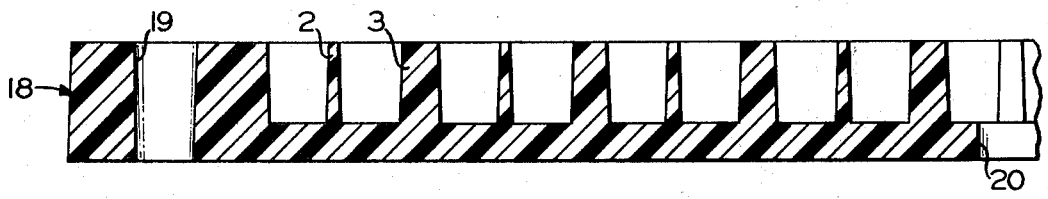
FIG. 3 is a partial elevational view, in cross section, of a fluid circuit plate constituting a second embodiment of the invention in which chambers are formed in only the upper side of the fluid circuit plate.

FIG. 3 shows a partial elevational view, in cross-section, of a fluid circuit plate 18 that constitutes a second embodiment of the invention. This fluid circuit plate 18 may be secured to an upper cover plate identical to the upper cover plate 6 of the circuit module 5 shown in FIG. 5 except it is constructed of metal instead of plastic to give rigidity, to provide a two-member circuit module. Only such features of the structure and operation of the embodiment of FIG. 3 which differ from that of the embodiment of FIGS. 1 and 2 will be hereinafter described.

According to the second embodiment of the invention shown in FIG. 3, this fluid circuit plate 18 is substantially onehalf the thickness of the fluid circuit plate 1 shown in FIGS. 1 and 2 and has formed in only its upper side a plurality of polygonal chambers, each chamber being separated from an adjacent chamber by a thin wall or partition 2.

As in the first embodiment of the invention, one end of each of, for example, six intersecting partitions 2 extending upward from the upper side of the fluid circuit plate 18 is formed integral with and extends radially from a tapered strengthening post 3 that at one end, as shown in FIG. 3, is integral with this upper side of the fluid circuit plate 1. The other end of each of these partitions 2 is integral with and extends radially from another tapered strengthening post that corresponds to the strengthening post 4 shown in FIG. 1. As in the first embodiment of the invention, a plurality of passageways may be formed in the two-part circuit module comprising the fluid circuit plate 18 and the above-mentioned upper cover plate which may be secured thereto by a plurality of bolts and nuts (not shown), such as the bolts 10 and nuts 11 shown in FIG. 5. for receiving certain of these bolts, the fluid circuit plate 18 is provided with a plurality of bores 19, only one of which appears in FIG. 3, it being noted that this bore 19 extends through this plate 18 and is tapered inward from its upper end to its lower end. For receiving certain other bolts for securing an upper cover plate to the fluid circuit plate 18, this plate 18 is provided with any desired number of straight, smooth, short bores, such as the bore 20 shown in FIG. 3, it being noted that it is not necessary that these short bores 20 be tapered for the same reason as hereinbefore explained for the bores 16 shown in FIGS. 1 and 2.

The fluid circuit plate 18 shown in FIG. 3 may be cast in a mold from a thermoset plastic. The mold for casting therein the fluid circuit plate 18 may comprise two parts, one of which may be substantially the same as the upper part of the two-part mold used for the casting of the fluid circuit plate 1 except slightly thicker to provide the required thickness of the fluid circuit plate 18. The other part of the two-part mold for casting the fluid circuit plate 18 ould comprise a flat plate on which the first part would be supported in such a manner as to enable the cavities in the upper part of this two-part mold to be filled with hot, molten thermoset plastic when it is poured into this mold.

Subsequent to the solidifying and cooling of the thermoset plastic, the fluid circuit plate 18 could be removed from the mold and thereafter provided with one or more passageways by removing a plurality of selected partitions 2 in the same manner as hereinbefore described for the first embodiment of the invention. Thereafter, this fluid circuit plate 18 would be secured to an upper cover plate that is the same as the upper cover plate 6 shown in FIG. 5 except constructed of metal, as hereinbefore stated.

Figure 4:
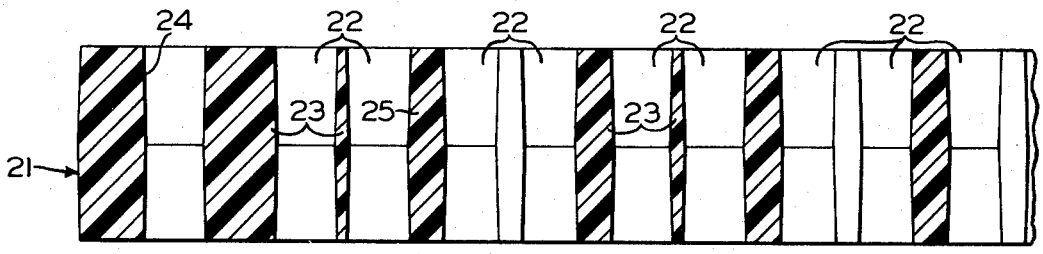
FIG. 4 is a partial elevational view, in cross section, of a fluid circuit plate constituting a third embodiment of the invention in which chambers or openings extend through the fluid circuit plate from one side thereof to the other side.

FIG. 4 shows a part of a fluid circuit plate 21 that constitutes a third embodiment of the invention. This fluid circuit plate 21 may be secured to the upper cover plate 6 and lower cover plate 7 in place of the fluid circuit plate 1 shown in FIG. 5 to form a circuit module for fluid distribution. Only such features of the structure and operation of the embodiment of FIG. 4 which differ from that of the embodiment of FIGS. 1 and 2 will be hereinafter described.

According to the third embodiment of the invention shown in FIG. 4, the fluid circuit plate 21 is provided with a plurality of polygonal chambers or openings 22 that extend therethrough from the upper side to the lower side rather than with a set of chambers formed in each side as the fluid circuit plate 1, or with one set of chambers formed in only one side as in the fluid circuit plate 18.

The fluid circuit plate 21 may also be cast in a two-part mold from a thermoset plastic, the parting line between the two parts of the mold being substantially midway the thickness of this fluid circuit plate. Therefore, to permit easy separation of the two parts of the mold subsequent to solidification and cooling of the thermoset plastic, a wall or partition 23 that separates each two adjacent polygonal chambers or openings is tapered in opposite directions from a point midway the thickness of the fluid circuit plate 21, as shown in FIG. 4.

For the same reason, any desired number of bores 24 for receiving the bolts that secure the fluid circuit plate 21 to the upper and lower cover plates to form a circuit module, and strengthening posts 25 are likewise tapered in opposite directions from a point midway the thickness of the fluid circuit plate 21. It will be understood tht a plurality of partitions 23 extend radially from each of these strengthening posts 25, as in the previous embodiments of the invention, and that each of these strengthening posts serves to prevent rupture or fracture of the other partitions extending radially therefrom when a selected one of the plurality of radial extending partitions is severed from the respective strengthening post to form a passageway in the fluid circuit plate 21 by the removal of a plurality of selected partitions.

Having now described the invention what I claim as new and desire to secure by Letters Patent, is:

1. For use as a component in a fluid pressure distribution circuit module, a fluid circuit plate comprising:

a. a plate member, b. a plurality of thin-walled partitions on said plate member defining a plurality of polygonal chambers, and wherein the improvement comprises;

c. a plurality of pairs of strengthening posts, each pair of posts being integral with the respective opposite ends of one of said plurality of partitions, and each post of each pair of posts being also integral with one end of several other partitions extending radially therefrom, the opposite end of each of said several other partitions being intergal with another post whereby each pair of posts is effective to render the respective partition having its opposite ends integral with this pair of posts selectively severable therefrom without damaging another partition extending radially from either one of this pair of posts.

2. A fluid circuit plate, as recited in claim 1, further characterized in that certain of said thin-walled partitions and strengthening posts are integral with and extend from one side of said plate member, and the remainder of said thin-walled partitions and strengthening posts are integral with and extend from the other side of said plate member, said partitions and posts defining on each side of said plate member a plurality of hollow polygonal chambers, said partitions on either or both sides of said plate member being selectively removable to form one or more passageways on the respective side, said strengthening posts on the respective side insuring removal of said selected partitions on said side without fracture of the remaining partitions.

3. A fluid circuit plate, as recited in claim 1, further characterized in that said thin-walled partitions and strengthening posts are integral with and extend from only one side of said plate member, said partitions and posts defining on said one side of said plate member a plurality of hollow polygonal chambers, said partitions being selectively removable to form one or more passageways, and said strengthening posts insuring removal of said selected partitions without damaging the remaining partitions.

4. A fluid circuit plate, as recited in claim 3, further characterized in that said partitions and said strengthening posts taper inwardly from their junction with said one side of said plate member.

5. A fluid circuit plate, as recited in claim 4, further characterized in that said plate member is provided with at least one bore that extends therethrough and is tapered from one end to the other end.

6. A fluid circuit plate, as recited in claim 4, further characterized in that the minimum diameter of said strengthening posts at their exterior end is 0.093 inch, and the taper of said strengthening post is 4° inwardly from their junction with said one side of said plate member.

7. A fluid circuit plate, as recited in claim 1, further characterized in that said partitions and said strengthening posts extend from one side of said plate member to the other side, thereby defining hollow polygonal chambers that extend through said plate member from one side to the other side.

8. A fluid circuit plate, as recited in claim 7, further characterized in that said partitions and said strengthening posts taper in opposite directions from a point midway their thickness.

9. A fluid circuit plate, as recited in claim 1, further characterized in that said partitions and said strengthening posts taper inwardly from their junction with the respective sides of said plate member.

10. A fluid circuit plate, as recited in claim 9, further characterized in that the minimum diameter of said strengthening posts is 0.093 inch, and the taper of said strengthening posts is 4° inwardly from their junction with the respective side of said plate member

11. A fluid circuit plate, as recited in claim 9, further characterized in that said plate member is provided with at least one bore that extends therethrough from one side to the other side and is tapered in opposite directions from a point midway its length.

* * * * *